US007137449B2

(12) United States Patent
Silguero

(10) Patent No.: US 7,137,449 B2
(45) Date of Patent: Nov. 21, 2006

(54) MAGNET ARRANGEMENT AND METHOD FOR USE ON A DOWNHOLE TOOL

(75) Inventor: Benny L. Silguero, Houston, TX (US)

(73) Assignee: M-I L.L.C., Houston, TX (US)

( * ) Notice: Subject to any disclaimer, the term of this patent is extended or adjusted under 35 U.S.C. 154(b) by 33 days.

(21) Appl. No.: 10/865,486

(22) Filed: Jun. 10, 2004

(65) Prior Publication Data

US 2005/0274524 A1 Dec. 15, 2005

(51) Int. Cl.
*E21B 31/06* (2006.01)

(52) U.S. Cl. ..... 166/301; 166/99; 166/68.5; 294/65.5

(58) Field of Classification Search ..... 166/311, 166/301, 66.5, 99, 255.1, 250.12; 175/328; 294/65.5

See application file for complete search history.

(56) References Cited

U.S. PATENT DOCUMENTS 3,637,033 A 1/1972 Mayall ..... 175/320
6,269,877 B1 8/2001 Zeer et al. ..... 166/66.5
6,354,386 B1 3/2002 Ruttley ..... 175/328
6,357,539 B1 3/2002 Ruttley ..... 175/328
6,491,117 B1 12/2002 Ruttley ..... 175/328
6,629,562 B1 10/2003 Fidan ..... 166/99
6,655,462 B1 * 12/2003 Carmichael et al. ..... 166/311
6,702,940 B1 3/2004 Blange ..... 210/222

OTHER PUBLICATIONS

International Search Report dated Feb. 28, 2006 for Application No. PCT/US05/20478 (4 pages).

* cited by examiner

*Primary Examiner*—David Bagnell
*Assistant Examiner*—Matthew J. Smith
(74) *Attorney, Agent, or Firm*—Osha Liang LLP

(57) ABSTRACT

The present invention relates to a downhole tool for removing metallic debris from a well bore. The downhole tool includes a plurality of magnets disposed on the tool body. The plurality of magnets are arranged in a bucking arrangement such that repulsing forces are generated between neighboring pairs of the plurality of magnets. The bucking arrangement results in an expanded reach of the magnetic fields of the magnets to enhance the removal of metallic debris.

33 Claims, 5 Drawing Sheets

MAGNET ARRANGEMENT AND METHOD FOR USE ON A DOWNHOLE TOOL

BACKGROUND OF INVENTION

Background Art

A well bore may be drilled in the earth for various purposes, such as hydrocarbon extraction, geothermal energy, or water. After a well bore is drilled, the well bore is typically lined with casing. The casing preserves the shape of the well bore as well as provides a sealed conduit for fluid to be transported to the surface.

A common problem in well bores is the accumulation of metallic debris. The metallic debris can be in the form of small metal shavings. Metal shavings can enter the hydrocarbon producing formation and reduce production. Metallic debris may be generated by tools on a work string scraping against the inside of the casing. Also, metallic debris is created while milling metal objects downhole, such as a bridge plug or packer. Some of the metallic debris may be brought back to the surface by well fluids that are circulated in the well bore, but a significant amount may still remain in the well bore.

Corrosion and other damage degrades the interior of the metal casing over time, which leaves a rough surface. This condition is typically cured by running tools in and out of the well bore with wire brushes and scrapers to abrade the inside of the casing. A scraper typically includes steel blades disposed on the outside of a cylindrical tool. The blades are biased radially outward by springs so that the scraper abrades the inside of the casing. The scraper helps to dislodge rough particles that are magnetically attracted to the casing or embedded in the casing wall. Wire brushes serve a similar purpose, but typically remove smaller particles. Some of the removed material is in the form of small metallic shavings and flakes of metal. Fluid is circulated during this operation to lift the removed material to the surface, but some metallic debris is left in the well bore.

Many tools exist that use magnets to attract and hold metallic debris, allowing the metallic debris to be removed from the well bore. Typically, permanent magnets in the form of buttons or bars are spaced apart to cover the outside of the magnetic tool. Metallic debris is attracted to each magnet allowing the removal of debris. Increased removal of metallic debris is accomplished by using more and larger magnets.

An example of a magnetic tool used to remove metallic debris is provided in U.S. Pat. No. 6,591,117 B2, entitled "Apparatus for Retrieving Metal Debris from a Well Bore." In the '117 patent, large bar magnets are spaced apart around and along a tool body to attract metal debris. The bar magnets are fitted into recesses in the tool body and arranged to have an area between each magnet for metallic debris to settle.

SUMMARY OF INVENTION

In one aspect, the present invention relates to a downhole tool for removing metallic debris from a well bore. The downhole tool includes a body that is able to connect to a work string. Two or more hoop magnets are disposed coaxially along the length of the body, and arranged in a bucking arrangement.

In one aspect, the present invention relates to a downhole tool for removing metallic debris from a well bore. The downhole tool includes a body with a mandrel and a central opening. The body is able to connect to a work string. A magnet assembly is disposed on the mandrel. The magnet assembly includes an inner sleeve designed to fit around the mandrel. A plurality of hoop magnets are disposed on the inner sleeve and spaced apart along the length of the inner sleeve. The plurality of hoop magnets are arranged in a bucking arrangement.

In one aspect, the present invention relates to a downhole tool for removing metallic debris from a well bore. The downhole tool includes a body that is able to connect to a work string. A plurality of magnets are distributed azimuthally around the circumference of the body. The plurality of magnets are arranged in a bucking arrangement.

In one aspect, the present invention relates to a downhole tool for removing metallic debris from a well bore. The downhole tool includes a body with a mandrel and a central opening. The body is able to be connect to a work string. A magnet assembly is disposed on the mandrel. The magnet assembly includes an inner sleeve designed to fit around the mandrel. A plurality of magnets are distributed azimuthally around the circumference of the inner sleeve. The plurality of magnets are arranged in a bucking arrangement.

Other aspects and advantages of the invention will be apparent from the following description and the appended claims.

DETAILED DESCRIPTION

In one aspect, the present invention relates to an arrangement of magnets for removing metallic debris from a well bore. More specifically, embodiments of the present invention have a plurality of magnets spaced apart so that the magnetic field of each magnet interacts with the magnetic field of its neighbor to increase the effectiveness of the magnet arrangement to remove metallic debris from a well bore.

Figure 1:
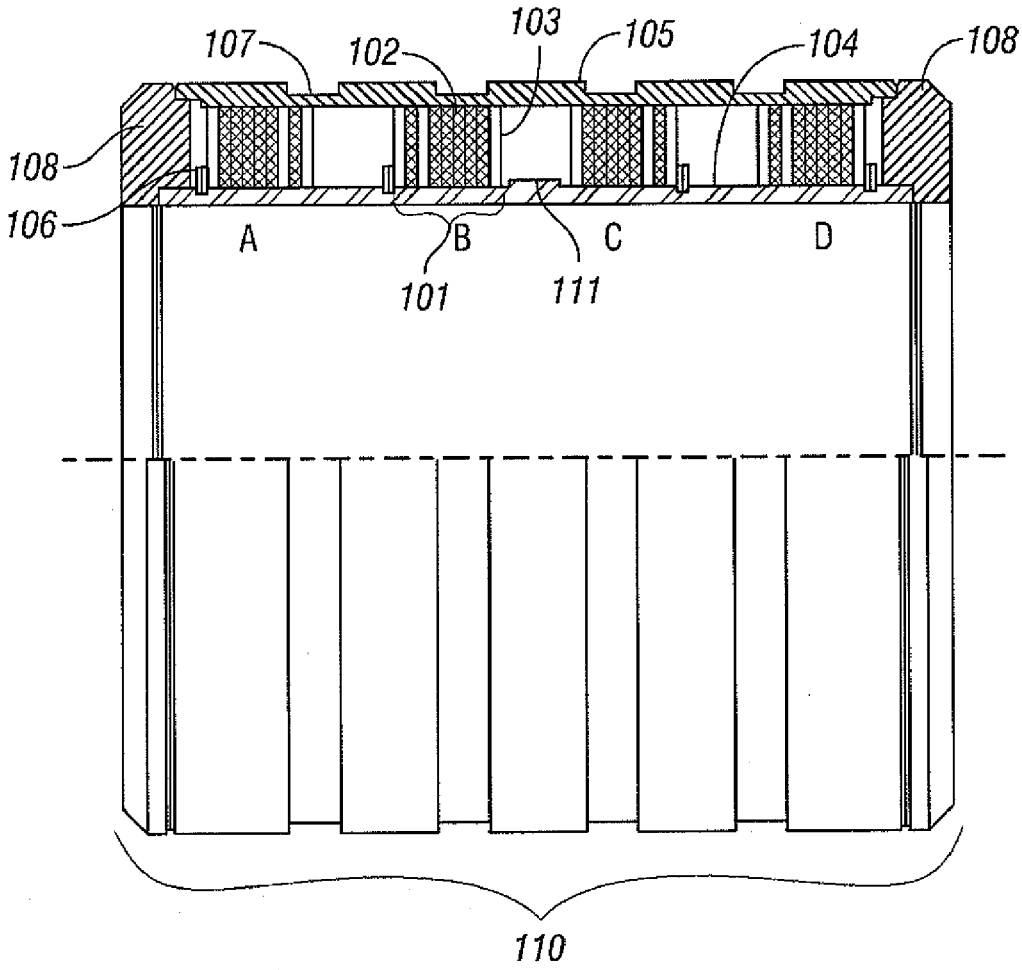
FIG. 1 shows a quarter-section of a magnet carrier in accordance with one embodiment of the invention.

FIG. 1 shows a magnet carrier 110 in accordance with one embodiment of the present invention. A plurality of ring shaped magnets 101 are disposed on an inner sleeve 104.

Each magnet 101 may comprise an assembly of individual magnet rings 102 and spacer rings 103. The magnet rings 102 may be permanent magnets made of any suitable magnetic material, such as neodymium iron boron, ceramic ferrite, samarium cobalt, or aluminum nickel cobalt. In one embodiment, spacer rings 103 may be made of a carbon steel with magnetic properties, or any other material that exhibits magnetic properties. The magnet rings 102 are aligned within each magnet 101 by their magnetic poles to attract each other. The spacer rings 103 are magnetized and attracted to the magnet rings 102. The spacer rings 103 may be used to indicate the magnetic pole of each magnet. For example, two spacer rings 103 separated by a magnet ring 102 may represent the magnetic north of the magnet 101, while one spacer ring 103 may represent the magnetic south of the magnet 101. Alternatively, the spacer rings 13 may have markings to indicate the poles of the magnet 101. Coloring magnet rings 102 or otherwise marking the magnets may accomplish the same purpose. This feature is used to clearly indicate which ends of the magnet 101 will attract other magnets for assembly and safety purposes.

In the embodiment shown in FIG. 1, the inner sleeve 104 is designed to accommodate four magnets 101. The inner sleeve 104 may be sized to fit around a mandrel (not shown). To prevent dissipation of the magnet strength, the inner sleeve 104 may be formed from an austenitic stainless steel, or other material that exhibits little or no magnetic susceptibilities. A center ridge 111 may be formed on the inner sleeve 104 for assembly purposes.

To assemble this embodiment, a first magnet 101B may be placed against the center ridge 111. The first magnet 101B may be fixed in place by a retaining device, such as a retaining ring 106 or a snap ring. A second magnet 101A may be installed on the same side of the center ridge 111. The second magnet 101A is oriented so that the same magnetic pole faces the first magnet 101B, such as north to north. Both magnets 101A and 101B are in close proximity to each other so that their magnetic fields repulse each other, resulting in a substantial repulsive force. The second magnet 101A may also be secured in place by a retaining ring 106. The same procedure may be repeated for magnets 101C and 101D.

After all four magnets 101A–101D are secured, an outer sleeve 105 may be placed around the magnets 101A–101D. The outer sleeve 105 is preferably formed of a material exhibiting little or no magnetic susceptibility, such as an austenitic stainless steel, to prevent interference with the magnetic fields of the magnets 101. The outer sleeve 105 provides protection for the magnets 101 and a gathering surface for magnetic debris. In one embodiment, grooves 107 are formed in the outside surface of the outer sleeve 105. The grooves 107 help to retain metallic debris.

After the outer sleeve 105 is installed, end caps 108 may be placed on the magnet carrier 110. The end caps 108 may be secured by an interference fit between the outer sleeve 105 and inner sleeve 104. Alternatively, the end caps 108 may be threaded or secured by any other means known in the art. The end caps 108 are preferably formed of a material exhibiting little or no magnetic susceptibility to prevent interference with the magnetic fields of the magnets 101. The individual features in this particular embodiment are intended to illustrate how a magnet carrier may be assembled in accordance with one embodiment of the present invention. However, they are not intended to limit the scope of the invention. For example, the magnets may be held in place by other means, such as an adhesive. In one embodiment, the magnets are assembled from one end of the inner sleeve without a center ridge. One of ordinary skill in the art will appreciate that magnets may be assembled into a magnet carrier in different ways without departing from the scope of the invention. Furthermore, some embodiments may not include the magnet carrier. Instead, the magnet arrangement may be disposed directly onto a tool body, for example.

While the above embodiment combines separate magnet rings to form a magnet, other magnet forms may be selected to use in a similar manner. For example, the magnet 101 may be a single piece instead of a combination of magnet rings 102. Furthermore, the magnet 101 or magnet rings 102 need not be in a contiguous ring shape. Instead, they may comprise sections that substantially form a ring.

Figure 2A:
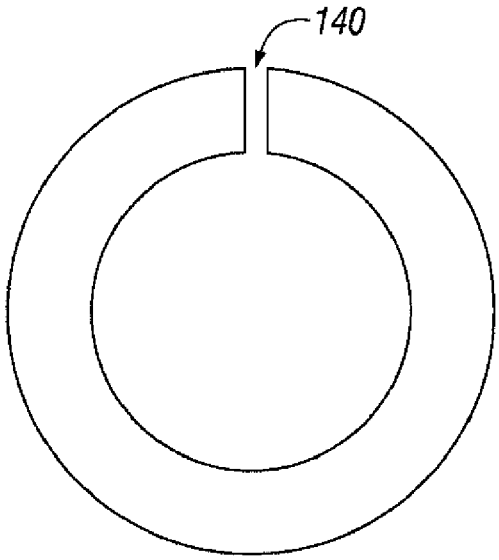
FIG. 2A shows a cross-section of a magnet in accordance with an embodiment of the present invention.
Figure 2B:
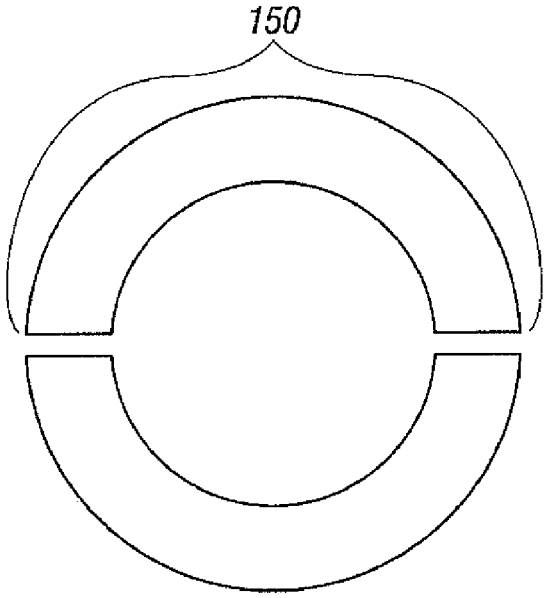
FIG. 2B shows a cross-section of a magnet in accordance with an embodiment of the present invention.
Figure 2C:
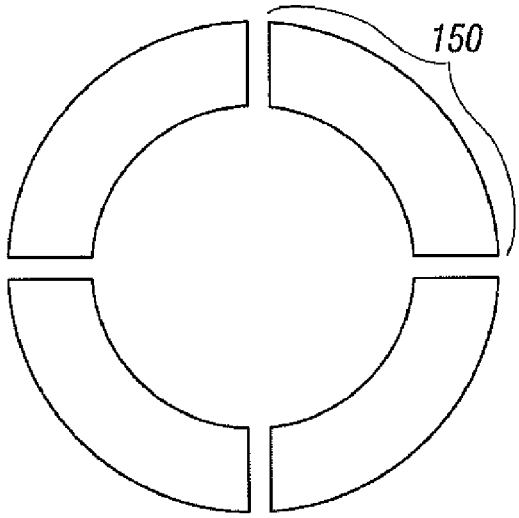
FIG. 2C shows a cross-section of a magnet in accordance with an embodiment of the present invention.

FIGS. 2A, 2B, and 2C show transverse cross-sections of magnets in accordance with some embodiments of the present invention. FIG. 2A shows a magnet having a slot 140. Alternatively, the magnet may be a plurality of arcuate sections 150, such as that shown in FIGS. 2B and 2C, and disposed circumferentially about the inner sleeve resulting in a substantially 360 degree magnetic field about the magnet carrier. One of ordinary skill in the art will appreciate that other shapes or groupings of magnets may be used to provide a substantially 360 degree magnetic field about the magnet carrier without departing from the scope of the invention. For the purpose of clarity, a single magnet or a set of magnets forming a substantially 360 degree magnetic field will be referred to hereinafter as a "hoop magnet." For example, four quarter-sections of a magnet ring disposed circumferentially about the inner sleeve at about the same longitudinal position form a hoop magnet for the purpose of this disclosure. For the present invention, a hoop magnet has two poles oriented to be substantially parallel to the axis of the hoop magnet.

Figure 3:
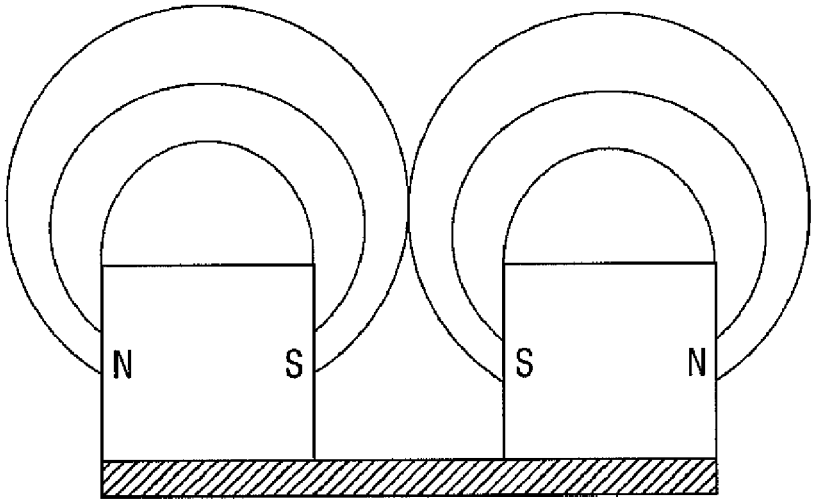
FIG. 3 shows an arrangement of magnets in accordance with one embodiment of the invention.

The magnetic orientation and distance of each hoop magnet relative to a neighboring hoop magnet allows for a magnetic field with an increased radial size to be created. As is known in the art, a magnet generally has a north and a south pole. When two magnets have opposite poles facing each other (i.e., north to south), the magnets are attracted to each other. Like magnetic poles repulse each other. FIG. 3 illustrates the effect of magnetic fields interacting in accordance with an embodiment of the present invention. The magnetic fields are represented by the lines arcing from the blocks labeled with N (north) and S (south). When magnets are oriented to repulse each other as in FIG. 3, the magnetic field of each magnet is deflected by the neighboring magnet. This phenomenon is commonly referred to as "bucking." The deflection of the magnetic fields in the manner shown in FIG. 3 results in magnetic fluxes oriented in the same direction between the neighboring magnets. The summation of the magnetic fluxes gives rise to a magnetic field that projects further outward from between the two magnets. This results in a magnetic field with greater outward reach than the magnetic field of a single magnet with the same strength. Arranging a plurality of hoop magnets in this manner allows for a larger apparent magnetic field for a magnet arrangement. The term "bucking arrangement" is utilized to clearly and concisely describe the type configuration for the two or more magnets as disclosed herein.

The longitudinal spacing of the hoop magnets vary depending the characteristics of the hoop magnets, such as the strength of the magnetic field. If the hoop magnets are too far apart, the bucking effect is reduced, causing the hoop magnets to act more individually. When moving the hoop magnets close together, the bucking effect increases, causing the magnetic field to expand radially. At the same time, the overall coverage of the magnetic field in the longitudinal direction is reduced for a given number of hoop magnets. Because the well bore is limited in diameter, the radial reach of the magnetic field is wasted much beyond the well bore. Therefore, it is desirable to balance the length and radial reach of the magnetic field created by the magnet arrangement. In one embodiment, six ceramic ferrite hoop magnets 1 inch in height are disposed ¾ of an inch apart longitudinally.

The number of hoop magnets spaced longitudinally in the magnet carrier may vary. Two or more hoop magnets may be spaced longitudinally in accordance with embodiments of the present invention. In one embodiment, six hoop magnets are used. In another embodiment, five hoop magnets are spaced apart in the magnet carrier. One of ordinary skill in the art will appreciate that the number of hoop magnets in the magnet carrier can vary without departing from the scope of the invention.

Figure 4A:
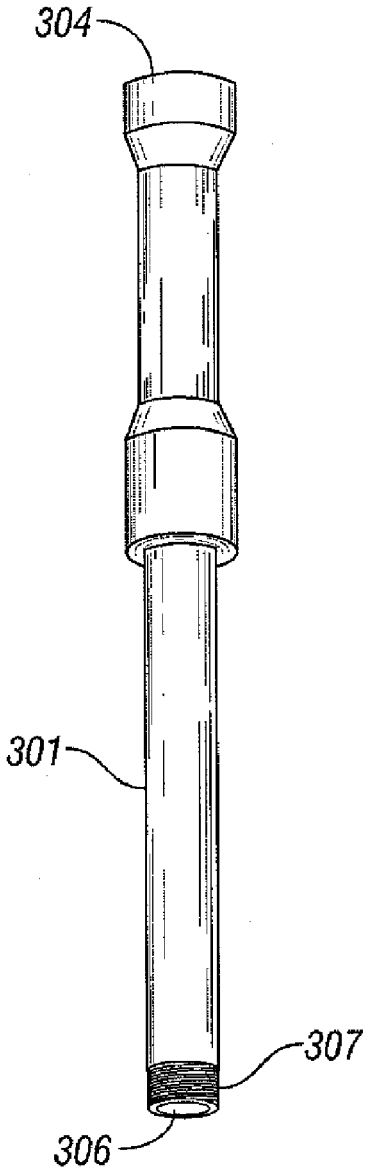
FIG. 4A shows a tool body in accordance with one embodiment of the invention.
Figure 4B:
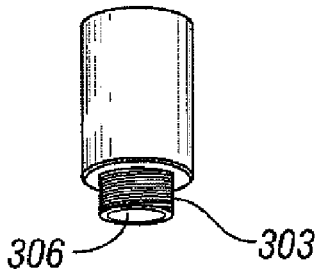
FIG. 4B shows a part adapted to attach to the tool body of FIG. 3A in accordance with an embodiment of the present invention.

FIGS. 4A and 4B show a downhole tool body in accordance with one embodiment of the present invention. The downhole tool body shown in FIGS. 4A and 4B is adapted to connect to a work string on both ends by a box connection 304 and a pin connection 303. The downhole tool body includes two components illustrated apart in FIGS. 4A and 4B. The component in FIG. 4A has a mandrel 301 adapted to accommodate additional components, such as a magnet carrier, scraper, brush, and centralizer. The additional components may be secured on the downhole tool body by connecting the end body in FIG. 4A to the tool body in FIG. 4B by connection 307. While a threaded connection is shown, one of ordinary skill in the art would appreciate that other connections may be used without departing from the scope of the invention. The downhole tool body includes a central opening 306 to allow fluid to circulate through the work string.

Figure 4C:
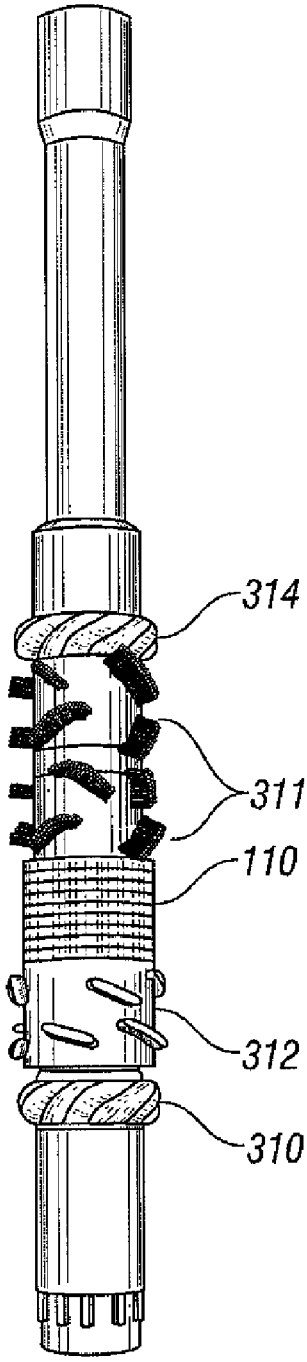
FIG. 4C shows a downhole tool having a magnet carrier in accordance with one embodiment of the present invention.

Turning to FIG. 4C, an assembled downhole tool in accordance with an embodiment of the invention is shown. Several components have been disposed on the mandrel 301 and secured by connecting the component in FIG. 4A to the component in FIG. 4B. From bottom to top, the components are a lower centralizer 310, a scraper module 312, a magnet carrier 110, two brush modules 311, and an upper centralizer 314. This is just one example of a module arrangement. An alternative arrangement may be a centralizer, two scraper modules, two magnet carriers, and a centralizer. A longer mandrel would allow for additional modules. One of ordinary skill in the art will appreciate that more or less modules with these or other known components may be used without departing from the scope of the invention. The combination of modules will vary depending on the purpose of the operation and the conditions of a particular well bore. For example, if the objective is only to remove metallic debris in the well, multiple magnet carriers may be deployed without any brush or scraper modules. In one or more embodiments, a boot basket module may be disposed on the mandrel to capture both metallic and non-metallic debris.

The module arrangement shown in FIG. 4C allows for the magnet carrier 110 to capture metallic debris (not shown) as it is dislodged from the casing (not shown) by the brush modules 311 and scraper module 312. This reduces the amount of metallic debris that would normally settle to the bottom of the well bore and potentially reduce future production. The centralizers 310 keep the downhole tool centered in the well bore so that the inside of the casing is cleaned evenly. The centered arrangement also helps to ensure that the magnetic field of the magnet carrier is fully utilized to extract metallic debris from the well fluid.

Modules disposed on a mandrel as shown in the above embodiment may not be forced to rotate with the rest of the work string. The modules are confined longitudinally, but are free to rotate azimuthally. This reduces the wear on the casing and on the modules. This containment system also allows for simple replacement of modules when a module wears out or when other configurations are desired.

Figure 5:
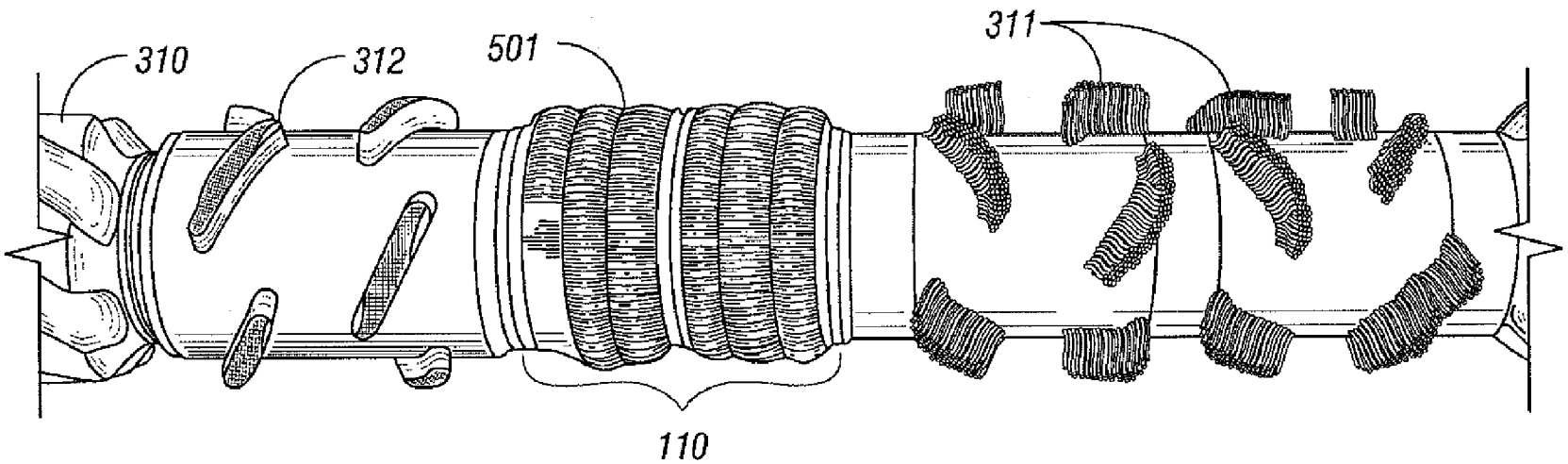
FIG. 5 shows a downhole tool having a magnet carrier with attached metallic debris in accordance with one embodiment of the present invention.

FIG. 5 shows a portion of the downhole tool of FIG. 4C in accordance with an embodiment of the present invention. The downhole tool has been run into a well bore to remove metallic debris, primarily metal shavings. In this embodiment, the magnet carrier has six hoop magnets. The metal shavings 501 have collected on the magnet carrier 110 at the location of each hoop magnet. The hoop magnet arrangement in accordance with an embodiment of the present invention provides a substantially continuous magnetic field around and along the length of the magnet carrier.

While the above embodiments have included a modular type of magnet carrier, it should be understood that the hoop magnet arrangement that has been disclosed may be used in other downhole tools for the purpose of removing metallic debris from a well bore. For example, the inner sleeve may not be required if the hoop magnets are disposed directly onto a tool body adapted to attach to a work string. Additionally, the hoop magnets may be disposed at one end of a tool body adapted to attach to a work string at the other end. Hoop magnets disposed at the end of the tool may be able to effectively remove metallic debris that has settled at the bottom of the well bore. One of ordinary skill in the art will be able to utilize the disclosed hoop magnet arrangement in other downhole tool applications to remove metallic debris from a well bore without departing from the scope of the invention.

Figure 6A:
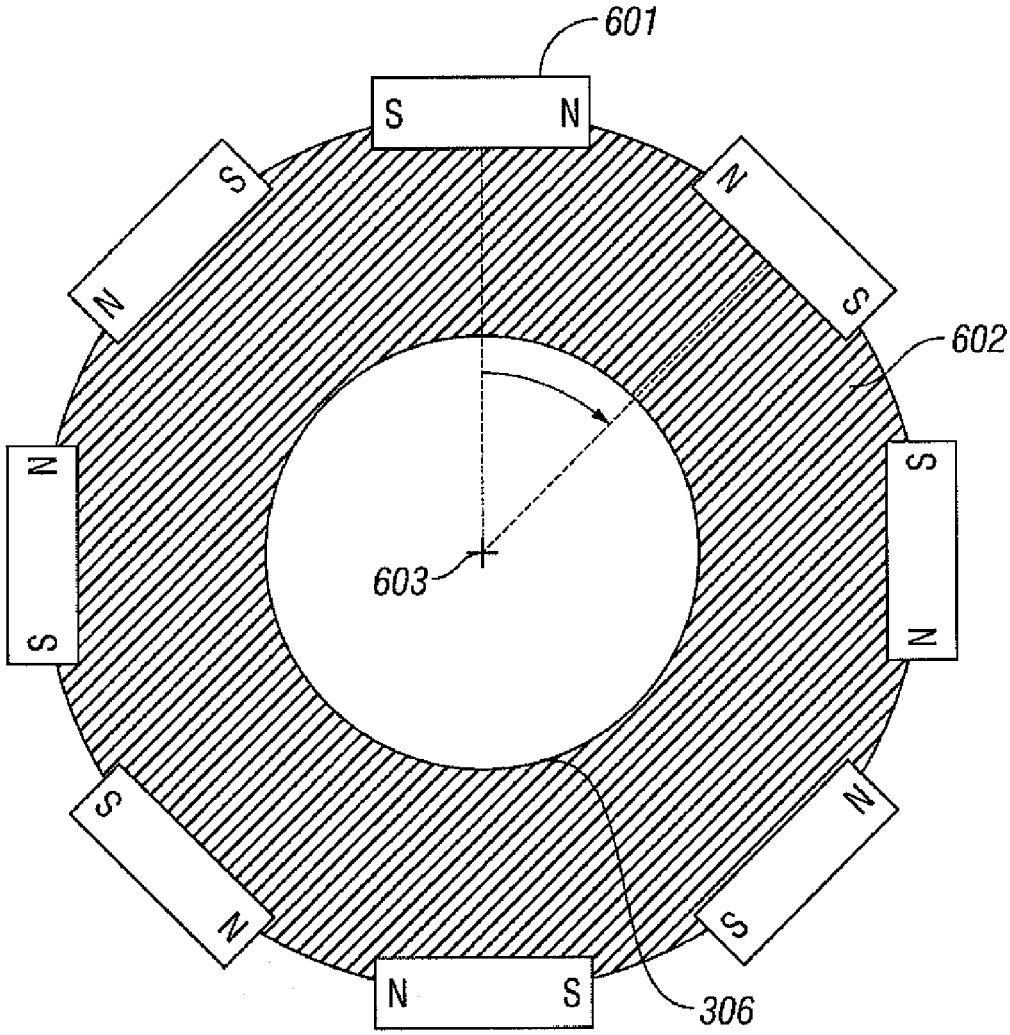
FIG. 6A shows an arrangement of magnets in accordance with one embodiment of the invention.

While the above embodiments have used hoop magnets, one having the benefit of this disclosure could utilize the bucking phenomenon with other magnets. FIG. 6A shows a magnet arrangement in accordance with one embodiment of the present invention. The magnets 601 are aligned such that the poles are oriented substantially transverse to the axis 603 of the tool body 602. The magnets 601 are distributed around the circumference of the tool body 602. The azimuthal spacing of the magnets 601 is selected so that bucking occurs between each adjacent magnet 601. The azimuthal spacing of the magnets 601 may vary based on several factors, such as magnetic strength, size of the tool body 602, and quantity of magnets 601 desired. Closer azimuthal spacing of the magnets 601 does not affect the longitudinal length of the magnetic field, because that is determined by the length of each magnet 601. A closer azimuthal spacing may result in difficulty in assembling the magnets 601 to the tool body 602. Additionally, a closer azimuthal spacing would require additional magnets 601 to surround the tool body 602. One of ordinary skill in the art will appreciate that the azimuthal spacing and quantity of the magnets 602 may vary without departing from the scope of the invention.

The magnets 601 may be secured by any means known in the art, such as a bolt, straps, or adhesive. While the magnets 601 are shown directly attached to a tool body 602, the magnets 601 may be attached to a module similar to that shown in FIG. 1. To prevent depletion of the magnetic field, the tool body 602 or module may be formed from a material having little or no magnetic susceptibility, such as an austenitic stainless steel.

Figure 6B:
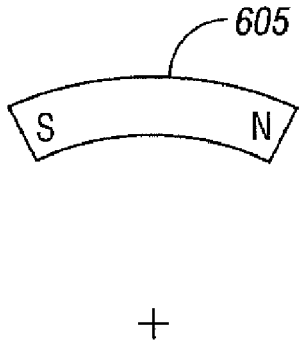
FIG. 6B shows a magnet in accordance with one embodiment of the present invention.

While the magnets 601 shown in FIG. 6A are rectangular in cross-section, other shapes of magnets may be used in a similar manner. FIG. 6B shows a cross-section of a magnet 605 that may be used for the magnet arrangement of FIG. 6A in accordance with one embodiment of the present invention. The magnet 605 shown in FIG. 6B has an arcuate shape that conforms to a circular tool body (not shown). One of ordinary skill in the art will appreciate that other shapes of magnets may be used in a similar manner without departing from the scope of the invention.

Embodiments of the present invention provide one or more of the following advantages. Metallic debris, especially small metal shavings, are suspended in the well fluid. As the magnet carrier passes by the metal shavings, the metal shavings are only attracted by the magnet carrier if they are within a strong portion of the magnetic field. To capture the metal shavings throughout the well fluid, the magnetic field must extend radially to the casing from the magnet carrier. This can be accomplished by utilizing bucking between the magnetic fields of two or more hoop magnets. As the magnet carrier passes through the well bore and well fluid flows by, metal shavings are pulled from the well fluid and attached to the magnet carrier.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole tool for removing metallic debris from a well bore, the downhole tool comprising:

a body adapted to connect to a work string;

a plurality of hoop magnets disposed coaxially along a length of the body; and wherein at least two longitudinally adjacent hoop magnets of the plurality of hoop magnets are arranged in a bucking arrangement.

2. The downhole tool of claim 1, further comprising:

an outer sleeve disposed around the plurality of hoop magnets.

3. The downhole tool of claim 2, wherein the outer sleeve is formed from a material with substantially no magnetic susceptibility.

4. The downhole tool of claim 2, wherein an outer circumference of the outer sleeve has at least one groove formed thereon.

5. The downhole tool of claim 1, wherein the body is formed from a material with substantially no magnetic susceptibility.

6. The downhole tool of claim 1, wherein the plurality of hoop magnets are fixed on the body by a retaining ring.

7. The downhole tool of claim 1, wherein the plurality of hoop magnets are formed from a material selected from ceramic ferrite, neodymium iron boron, samarium cobalt, and aluminum nickel cobalt.

8. A downhole tool for removing metallic debris from a well bore, the downhole tool comprising:

a body having a mandrel and a central opening and adapted to be coupled to a work string; and a magnet assembly disposed on the mandrel, the magnet assembly comprising;

an inner sleeve adapted to fit around the mandrel; and a plurality of hoop magnets disposed on the inner sleeve and spaced apart coaxially along a length of the inner sleeve, wherein at least two longitudinally adjacent hoop magnets of the plurality of hoop magnets are arranged in a bucking arrangement.

9. The downhole tool of claim 8, further comprising:

an outer sleeve disposed around the plurality of hoop magnets.

10. The downhole tool of claim 9, wherein the outer sleeve and inner sleeve are formed from a material with substantially no magnetic susceptibility.

11. The downhole tool of claim 9, wherein an outer circumference of the outer sleeve has at least one groove formed thereon.

12. The downhole tool of claim 8, wherein the body is formed from a material with substantially no magnetic susceptibility.

13. The downhole tool of claim 8, wherein the plurality of hoop magnets are fixed on the inner sleeve by a retaining ring.

14. The downhole tool of claim 8, wherein the plurality of hoop magnets are formed from a material selected from ceramic ferrite, neodymium iron boron, samarium cobalt, and aluminum nickel cobalt.

15. The downhole tool of claim 8, further comprising:

at least one module disposed on the mandrel selected from a scraper module, a brush module, boot basket, and a centralizer.

16. The downhole tool of claim 15, wherein the magnet carrier and at least one module are not rotatably fixed to the mandrel.

17. A downhole tool for removing metallic debris from a well bore, the downhole tool comprising:

a body adapted to connect to a work string;

a plurality of magnets distributed azimuthally around a circumference of the body and at least two azimuthally adjacent magnets of the plurality of magnets are arranged in a bucking arrangement.

18. The downhole tool of claim 17, further comprising:

an outer sleeve disposed around the plurality of magnets.

19. The downhole tool of claim 18, wherein the outer sleeve is formed from a material with substantially no magnetic susceptibility.

20. The downhole tool of claim 18, wherein an outer circumference of the outer sleeve has at least one groove formed thereon.

21. The downhole tool of claim 17, wherein the body is formed from a material with substantially no magnetic susceptibility.

22. The downhole tool of claim 17, wherein the plurality of hoop magnets are formed from a material selected from ceramic ferrite, neodymium iron boron, samarium cobalt, and aluminum nickel cobalt.

23. A downhole tool for removing metallic debris from a well bore, the downhole tool comprising:

a body having a mandrel and a central opening and adapted to be coupled to a work string; and a magnet assembly disposed on the mandrel, the magnet assembly comprising;

an inner sleeve adapted to fit around the mandrel; and a plurality of magnets distributed azimuthally around a circumference of the inner sleeve, wherein at least two azimuthally adjacent magnets of the plurality of magnets are arranged in a bucking arrangement.

24. The downhole tool of claim 23, further comprising:

an outer sleeve disposed around the plurality of magnets.

25. The downhole tool of claim 24, wherein the outer sleeve and inner sleeve are formed from a material with substantially no magnetic susceptibility.

26. The downhole tool of claim 24, wherein an outer circumference of the outer sleeve has at least one groove formed thereon.

27. The downhole tool of claim 23, wherein the body is formed from a material with substantially no magnetic susceptibility.

28. The downhole tool of claim 23, wherein the plurality of magnets are formed from a material selected from ceramic ferrite, neodymium iron boron, samarium cobalt, and aluminum nickel cobalt.

29. The downhole tool of claim 23, further comprising:

at least one module disposed on the mandrel selected from a scraper module, a brush module, boot basket, and a centralizer.

30. The downhole tool of claim 29, wherein the magnet carrier and at least one module are not rotatably fixed to the mandrel.

31. A method of removing metallic debris from a well bore, the method comprising:

connecting a downhole tool to a work string, wherein the downhole tool comprises a body adapted to connect to the work string and a plurality of hoop magnets disposed coaxially along the of the body and wherein at least two longitudinally adjacent hoop magnets of the plurality of hoop magnets are arranged in a bucking arrangement;

lowering the downhole tool into the well bore; and removing the downhole tool from the well bore.

32. A method of removing metallic debris from a well bore, the method comprising:

connecting a downhole tool to a work string, wherein the downhole tool comprises a body adapted to connect to the work string and a plurality of magnets distributed azimuthally around a circumference of the body and wherein at least two azimuthally adjacent magnets of the plurality of magnets are arranged in a bucking arrangement;

lowering the downhole tool into the well bore; and removing the downhole tool from the well bore.

33. A downhole tool for removing metallic debris from a well bore, the downhole tool comprising:

a body having a mandrel and a central opening and adapted to be coupled to a work string;

at least one module disposed on the mandrel selected from a scraper module, a brush module, boot basket, and a centralizer; and a magnet assembly disposed on the mandrel, the magnet assembly comprising;

an inner sleeve adapted to fit around the mandrel, wherein the inner sleeve is formed from a material with substantially no magnetic susceptibility;

a plurality of hoop magnets disposed on the inner sleeve and spaced apart coaxially along a length of the inner sleeve, wherein at least two longitudinally adjacent magnets of the plurality of hoop magnets are arranged in a bucking arrangement; and an outer sleeve disposed around the magnets, wherein the outer sleeve is formed from a material with substantially no magnetic susceptibility.

* * * * *